US005486299A

United States Patent [19]

Fuwa et al.

[11] Patent Number: 5,486,299

[45] Date of Patent: Jan. 23, 1996

[54] WEAR-RESISTANT LUBRICANT COMPOSITION

[75] Inventors: Yoshio Fuwa; Kouji Saitou, both of Aichi; Jiro Yamashita, Kanagawa, all of Japan

[73] Assignees: Dow Corning Asia, Ltd, Tokyo; Toyota Motor Company, Aichi, both of Japan

[21] Appl. No.: 333,462

[22] Filed: Nov. 2, 1994

[30] Foreign Application Priority Data

Nov. 2, 1993 [JP] Japan ..... 5-274576

[51] Int. Cl.[6] ..... C10M 107/44; C02F 1/00; C02F 3/10

[52] U.S. Cl. ..... 252/12; 252/30

[58] Field of Search ..... 252/12, 30

[56] References Cited

U.S. PATENT DOCUMENTS

| | | | |
|---|---|---|---|
| 3,781,205 | 12/1973 | Cairns et al. | 252/12 |
| 3,844,953 | 10/1974 | Campbell et al. | 252/12 |
| 3,879,301 | 4/1975 | Cairns et al. | 252/12 |
| 3,994,814 | 11/1976 | Cairns | 252/12 |
| 4,050,855 | 9/1977 | Sakamaki et al. | 252/12 |
| 4,532,054 | 7/1985 | Johnson | 252/12 |
| 4,715,972 | 12/1987 | Pacholke | 252/30 |
| 4,831,977 | 5/1989 | Presswood | 252/12 |
| 4,892,669 | 1/1990 | Marcora et al. | 252/30 |
| 5,415,791 | 5/1995 | Chou et al. | 252/12 |

FOREIGN PATENT DOCUMENTS 4175442 6/1992 Japan .

*Primary Examiner*—Jerry D. Johnson
*Attorney, Agent, or Firm*—Robert Spector

[57] ABSTRACT

The present lubricant compositions comprise a mixture of graphite, molybdenum disulfide and polytetrafluoroethylene in specified proportions within a matrix of an organic resin. When applied to surfaces that are in sliding contact with one another the compositions exhibit high wear resistance, good initial conformability, and a coefficient of friction following use that is lower than the initial coefficient of friction. The compositions are particularly suited for application to engine pistons.

1 Claim, 3 Drawing Sheets

WEAR-RESISTANT LUBRICANT COMPOSITION

BACKGROUND OF THE INVENTION

1. Field of the Invention

This invention relates to wear-resistant lubricant compositions suitable for use on surfaces that are in sliding contact with one another. The compositions are particularly useful for coating the surfaces of pistons and/or cylinders of engines using alcohol or other non-petroleum-based products as fuel.

2. Background Information

To increase the rotating velocity, compression ratio and mileage of diesel type engines and reduce their weight, there is an ever increasing demand for development of parts that are smaller and formed from light-weight metal alloys. This trend has resulted in an increased demand for improved resistance to wearing and seizure at the interfaces between parts such as pistons and cylinder walls that are in sliding contact with one another.

Due to a decrease in the supply of petroleum-based fuels, replacement of these fuels with alcohol-based fuels has been considered for diesel engines. The use of alcohol-based fuels has resulted in a high demand for increased resistance to wear and corrosion between stationary and sliding parts of diesel engines, such as at the interfaces between cylinder bores and piston skirt portions. Meeting this requirement has been the objective of much research.

For the sliding parts of diesel engines operating on non-petroleum-based fuels, when the stationary and moving parts, such as the cylinder bore and the skirt portion of a piston contain the same type of metal, seizure may occur due to sticking of metal parts of the same type. This is a disadvantage. In order to prevent sticking between metal parts of the same type, testing has been conducted with the objective of forming a resin coating layer on the surface of the piston skirt portion. In order to improve the sliding performance of the resin coating layer, various types of solid lubricants have been tried in combination with the resin.

For example, in the method disclosed in Japanese Kokai Patent Application No. Sho 51[1976]-97812, a type of resin composition for sliding type lubrication with improved durability of the resin coating layer is prepared by blending polyamide resin or silicone resin, or other heat-resistant resin as a binder with solid lubricants consisting of 10–75 wt % of graphite, 0.1–60 wt % of $MoS_2$ (molybdenum disulfide), and 1–20 wt % of PTFE (polytetrafluoroethylene). The solid lubricants constitute up to 75 weight percent of the total composition.

Japanese Kokai Patent Application No. Sho 54[1979]-162014 discloses a type of resin composition for lubricating members such as pistons that are in sliding contact with another surface. The composition is a blend of polyamide resin and PTFE, and it is able to reduce wear and noise level of the pistons.

Japanese Kokai Patent Application No. Sho 62[1987]-63628 discloses a type of resin composition for lubricating members in sliding contact with one another. The compositions contain 85 weight percent of a polyamidimide resin, 10 weight percent of $MoS_2$, boron nitride, graphite and other solid lubricants; and 5 wt % of PTFE.

Japanese Kokai Patent Application No. Hei 1[1989]-87851 discloses a type of resin composition for sliding type lubrication prepared by adding 25 to 125 parts by weight of PTFE to a 100 parts of a polyamide resin. The PTFE improves the wear resistance of the resin coating layer.

Japanese Kokai Patent Application No. Hei 4[1992]-175442 discloses a type of resin composition for sliding lubrication, such as between a piston and a cylinder bore. The composition contains 47 weight percent of a polyamidimide resin, 38 weight percent of $MoS_2$, 9 weight percent of PTFE, and 6 wt % of carbon as graphite. This composition has an improved resistance to seizure.

Japanese Kokai Patent Application No. 87/34280 describes a corrosion-resistant bolt containing on its surface a layer of a finely divided lead powder bonded with three trivalent chromium compounds that is in turn covered with a layer of lubricant composition containing from 20 to 70 weight percent of PTFE and from 1 to 5 weight percent of an inorganic lubricant such as $MoS_2$ or graphite.

Using any of the prior art lubricant compositions to reduce the coefficient of friction ($\mu$) between members in sliding contact with one another, the proportion of the solid lubricants with respect to resin must be increased. Using this approach, as the proportion of the solid lubricants added in the resin composition is increased, the bonding strength between the solid lubricant particles and the resin binder decreases to the extent that the solid lubricant particles may drop off easily due to sliding of one member against the other. Consequently, the coefficient of friction tends to rise and the wear rate of the resin coating layer tends to increase.

Using PTFE as the solid lubricant, as the proportion of this ingredient is increased, the coefficient of friction tends to decrease. However, when the proportion of PTFE becomes the major ingredient of the coating, the trend reverses. As the coefficient of friction increases, the rate at which the resin coating layer wears increases and peeling may occur. This is due to degradation of the wetting property of the sliding surfaces.

Using $MoS_2$ as the solid lubricants, as its relative concentration is increased, the coefficient of friction decreases, while the seizure resistance (load resistance) tends to increase. However, when the proportion of $MoS_2$ exceeds a level determined at least in part by the particle size of the $MoS_2$, there is a tendency for the surface roughness to increase and for the coefficient of friction to rise.

When carbon in the form of graphite is used as the solid lubricant, the seizure resistance, also referred to as load resistance, of the resin composition can be improved when $MoS_2$ is also present. However, when the proportion of graphite becomes higher than a value determined by the composition of the lubricant, the strength of the resin coating layer is significantly decreased, and the wear rate of the resin coating layer tends to rise.

While PTFE, $MoS_2$, and graphite are indispensable as solid lubricants, the present inventors have discovered that the relative concentrations of these ingredients as well as the total concentration of these ingredients relative to the resin matrix must be within specified ranges to achieve a low coefficient of friction and a low wear rate.

Resin layers formed from prior art resin-based lubricant compositions have poor initial conformability characteristics. Consequently, after a prescribed period of use as a lubricant in sliding contact environments, the coefficient of friction becomes larger than the initial coefficient of friction. This is related to the observed decrease in the wear resistance.

SUMMARY OF THE INVENTION

One objective of this invention is to provides solid resin type lubricant compositions for surfaces in sliding contact with one another. The compositions exhibit both a low coefficient of friction and a low wear rate.

The present lubricant compositions comprise a mixture of graphite, molybdenum disulfide and polytetrafluoroethylene in specified proportions within a matrix of an organic resin. When applied to surfaces that are in sliding contact with one another the compositions exhibit high wear resistance, good initial conformability, and a coefficient of friction following use that is lower than the initial coefficient of friction. The compositions are particularly suited for application to engine pistons.

DETAILED DESCRIPTION OF THE INVENTION

This invention provides wear-resistant lubricant compositions comprising from 50 to 73 weight percent of a binder consisting essentially of at least one member selected from the group consisting of polyamidimide resins and polyamide resins, and, as solid lubricants, from 3 to 15 weight percent of polytetrafluoroethylene, from 20 to 30 weight percent of molybdenum disulfide, and from 2 to 8 weight percent of graphite; wherein the total concentration of said solid lubricants constitutes from 27 to 50 percent of the total weight of said composition.

DESCRIPTION OF THE DRAWINGS

Referring to FIGS. 1 and 2, a lubricant-filled resin coating layer (4) is formed on the skirt portion (2) of piston (1) sliding inside a cylinder bore (3) made of cast iron FC-25 in a 6-cylinder gasoline engine with an exhaust volume of 3000 cc. A series of lands (21) and corresponding grooves of a prescribed shape are formed on the surface of the skirt portion (2). The contour of the lands (21) is determined by groove depth D and land pitch P.

Figure 1:
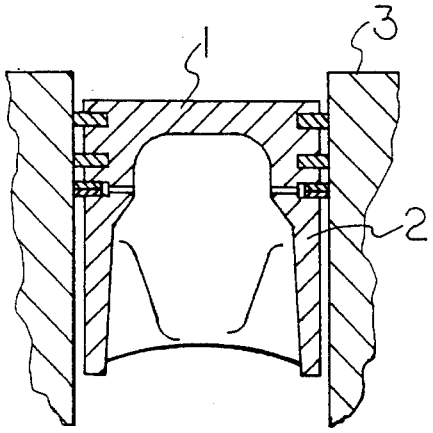
FIG. 1 is a cross-sectional view of a piston located within a cylinder bore.
Figure 2:
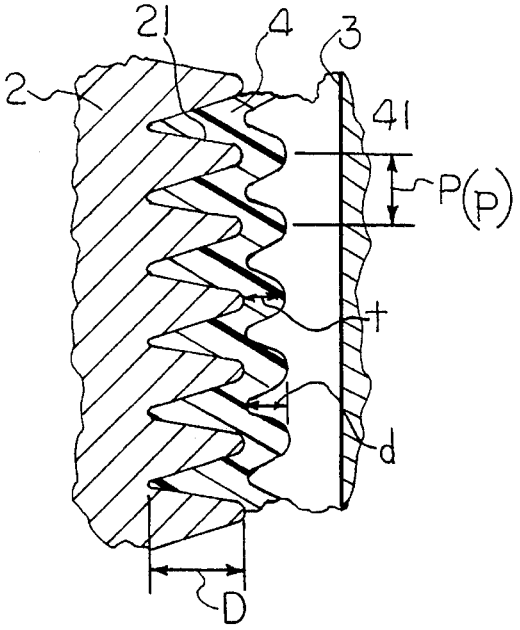
FIG. 2 is an enlarged cross-sectional view of the skirt portion (2) of a piston showing the contour of the lubricant-filled resin coating (4) as a series of lands and grooves.

The surface contour of the lubricant-filled resin follows the contour of lands (21), with the result that a land/groove pattern (41) of the same shape is formed on the surface of the coating layer (4). The contour of the land portions (41) on the resin coating layer (4) are determined by groove depth d and pitch p. The pitch P of lands (21) on the piston skirt portion (2) is made identical to pitch p of lands (41) of resin coating layer (4).

The present lubricant compositions exhibit excellent wear resistance and good initial conformability. During the initial portion of the use cycle a smooth sliding surface is formed due to sliding of the piston against the cylinder wall. As a result of this action, after a period of sliding contact, the coefficient of friction becomes smaller than the initial coefficient of friction, and the steady-state amount of wear of the resin-lubricant composite drops due to an increased wear resistance.

If required, the present resin-containing lubricant compositions can be diluted using an organic solvent prior to being applied on the substrate(s) to be lubricated.

EXAMPLES

The following examples describe preferred embodiments of the present compositions in more detail, and should not be interpreted as limiting the scope of the invention as defined in the accompanying claims. Unless otherwise specified, all parts and percentages in the examples are by weight and the viscosities reported were measured at 25° C.

The polyamidimide resin (PAI resin) used as the binder for the lubricating ingredients was dissolved in N-methyl-2-pyrrolidone. The solid lubricants, PTFE, $MoS_2$, and graphite, were added to the resultant solution, followed by crushing and stirring of the resultant solid/liquid mixture for 5 hours in a ball mill. The viscosity of the final coatable lubricant composition of the present invention was 120 cP (0.12 Pa.s).

The relative concentrations of solid lubricants (PTFE, $MoS_2$, and graphite) and polyamidimide resin were calculated based on a value of 100 weight percent for the combination of the three solid lubricants and polyamidimide resin. In Tables I and II the relative concentrations of solid lubricants are listed in the column headed "Proportion of Solid Lubricant," and the relative concentrations of polyamidimide resin are listed in Tables I and II in the column headed "Proportion of Resin Binder."

For the solid lubricants, the relative concentrations of PTFE, $MoS_2$, and graphite are expressed as weight percentages in the columns entitled "PTFE," "$MoS_2$," and "graphite", respectively. Sample Nos. 1–8 in Tables I and III correspond to the compositions of the present invention and sample Nos. 9–24 listed in Tables II and IV represent comparative examples that are outside of the scope of the present invention with respect to the relative concentrations of PAI resin as the binder and PTFE, $MoS_2$, and graphite as the solid lubricants.

The lubricant compositions were applied to substrates of an aluminum alloy identified as AC8A after the substrates had been degreased using alkali. The lubricant compositions were applied using an air operated spray gun to achieve a thickness in the range of 10–30 μm. The coatings were then sintered at 180° C. for 90 min to yield a cured layer of resin containing the lubricant composition.

TABLE I (Present Invention)

| Example No. | Composition of Lubricant[1] PTFE | $MoS_2$ | Graphite | Weight % Lubricant | Weight % Resin |
|---|---|---|---|---|---|
| 1 | 3 | 20 | 7 | 30 | 70 |
| 2 | 3 | 30 | 2 | 35 | 65 |
| 3 | 3 | 30 | 8 | 41 | 59 |
| 4 | 10 | 20 | 5 | 35 | 65 |
| 5 | 9 | 30 | 8 | 47 | 53 |
| 6 | 15 | 20 | 3 | 38 | 62 |
| 7 | 15 | 20 | 8 | 43 | 57 |
| 8 | 15 | 30 | 5 | 50 | 50 |

TABLE II (Comparative Examples)

| Example No. | Composition of Lubricant[1] PTFE | $MoS_2$ | Graphite | Weight % Lubricant | Weight % Resin |
|---|---|---|---|---|---|
| 9 | 0 | 0 | 0 | 0 | 100 |
| 10 | 2 | 25 | 5 | 32 | 68 |
| 11 | 3 | 20 | 2 | 25 | 75 |
| 12 | 5 | 15 | 6 | 26 | 74 |
| 13 | 10 | 20 | 1 | 31 | 69 |
| 14 | 10 | 30 | 10 | 50 | 50 |
| 15 | 15 | 20 | 1 | 36 | 64 |
| 16 | 15 | 30 | 10 | 55 | 45 |
| 17 | 20 | 25 | 5 | 50 | 50 |
| 18 | 20 | 40 | 20 | 80 | 20 |
| 19 | 9 | 38 | 6 | 53 | 47 |
| 20 | 50 | 0 | 0 | 50 | 50 |
| 21 | 5 | 10 | 0 | 15 | 85 |
| 22 | 5 | 0 | 10 | 15 | 85 |
| 23 | 0 | 40 | 10 | 50 | 50 |
| 24 | 0 | 20 | 30 | 50 | 50 |

[1]weight percent

Test for measuring Coefficient of Friction

A thrust type tester was used in the test, which was performed with a sliding velocity of 60 m/min for the aluminum substrate, a surface pressure of 9.8 MPa, and a mating surface of cast iron FC-25. The coefficient of friction was measured immediately after start of the test and 100 hours following the start of the test. The results are listed in Tables III and IV.

Test for Measuring Wear Rate

An LFW-1 tester was used in the test, which was performed with a sliding velocity for the aluminum substrate of 5 m/min, a surface pressure of 5 MPa, and mating surface of cast iron FC-25. The amount of wear in 5 min with lubrication was measured. The results are listed in Tables III and IV.

Test for Measuring Seizure Resistance

A thrust type tester was used in the test, which was performed with a sliding velocity of 60 m/min for the aluminum substrate, and mating surface of cast iron FC-25. The surface pressure was increased at a rate of 1 MPa per 2 minutes and the surface pressure when seizure occurred during this period was measured. The results are listed in Tables III and IV.

TABLE III (Present Invention)

| Example No. | Coefficient of Friction[2] 0 Hours | 100 hours | Amount of Wear (Micrometers) | Surface Pressure Upon Seizing (Mpa) |
|---|---|---|---|---|
| 1 | 0.033 | 0.031 | 4.9 | 28 |
| 2 | 0.031 | 0.028 | 5.1 | 29 |
| 3 | 0.033 | 0.025 | 4.5 | 30 |
| 4 | 0.032 | 0.029 | 5.7 | 28 |
| 5 | 0.031 | 0.027 | 5.1 | 27 |
| 6 | 0.029 | 0.026 | 5.4 | 30 |
| 7 | 0.030 | 0.027 | 4.9 | 30 |
| 8 | 0.029 | 0.025 | 5.2 | 29 |

TABLE IV (Comparative Examples)

| Example No. | Coefficient of Friction[2] 0 Hours | 100 hours | Amount of Wear (Micrometers) | Surface Pressure Upon Seizing (Mpa) |
|---|---|---|---|---|
| 9 | 0.048 | 0.051 | 13.0 | 13 |
| 10 | 0.040 | 0.048 | 8.3 | 20 |
| 11 | 0.033 | 0.041 | 7.3 | 21 |
| 12 | 0.036 | 0.045 | 8.1 | 22 |
| 13 | 0.035 | 0.038 | 7.5 | 22 |
| 14 | 0.037 | 0.045 | 6.9 | 21 |
| 15 | 0.033 | 0.041 | 8.1 | 21 |
| 16 | 0.038 | 0.045 | 7.9 | 23 |
| 17 | 0.041 | 0.042 | 7.5 | 21 |
| 18 | 0.039 | 0.039 | 9.8 | 16.5 |
| 19 | 0.042 | 0.042 | 7.8 | 22 |
| 20 | 0.045 | 0.048 | 8.5 | 15 |
| 21 | 0.036 | 0.039 | 6.3 | 23 |
| 22 | 0.034 | 0.039 | 7.1 | 15 |
| 23 | 0.040 | 0.045 | 7.3 | 18 |
| 24 | 0.041 | 0.041 | 6.8 | 15 |

[2]Measured immediately following start of test and 100 hours later.

The data in Table III demonstrate that for Examples 1–8, which contain relative concentrations of the resin binder and PTFE, $MoS_2$, and graphite within the ranges of this invention, the coefficients of friction measured after 100 hours of testing are lower than the values measured immediately after start of the test. The data indicate that these lubricant-containing resin layers exhibit a low initial coefficient of friction and a good initial conformability. The result is that during the sliding motion of the substrates, the surface of the resin coating layer is cut, and a good sliding surface is formed during the initial stage of sliding. In this way, the lubricant-containing resin coating layers of the present invention have an initial coefficient of friction immediately after start of the test that is lower than the values for the comparative samples. Also, the coefficient of friction after a prescribed time of sliding against the base substrate is lower than the initial coefficient of friction. As a result, the steady-state amount of wear is reduced, resulting in a high value of wear resistance.

For comparative examples 9–24, the coefficient of friction measured 100 hours following the start of the test is higher than the initial value, and the amount of wear is correspondingly increased. Also, the initial coefficients of friction immediately after start of the test are higher than the values measured for examples 1–8, which represent compositions of the present invention.

For Comparative Examples 18 and 19, as the total concentration of solid lubricants is increased, the bonding strength with the resin binder becomes insufficient, and the wear resistance decreases. Also, as the relative concentration of $MoS_2$ is increased, the coefficient of friction also increases. In Comparative Example 18, an increase in the relative concentration of graphite above the present range decreases the wear resistance of the lubricant composition.

In Comparative Example 20, as the relative concentration of PTFE is above the range of the present invention, the wetting property of the sliding surface is degraded, resulting in an increase in the coefficient of friction rises, a decrease in the hardness of the coating and an increase in the amount of wear.

In Comparative Example 21, the absence of graphite eliminates the synergic effect with $MoS_2$ with respect of improving the seizure resistance.

In Comparative Examples 23 and 24 the absence of PTFE, which is most closely related to the friction characteristics, makes it impossible to achieve a low coefficient of friction.

With respect to the types of solvents that can be used to prepare the present compositions, in addition to N-methyl-2-pyrrolidone used in the foregoing examples, other solvents such as N,N-dimethylformamide, can also be used. In this application example, the commercially available polyamidimide varnish (made of 30 wt % of PAI resin, 50 wt % of n-methyl-2-pyrrolidone, and 20 wt % of xylene) was used, with the proportion of its solid component (PAI resin) determined appropriately to ensure the proportion for the resin binder listed in Table I. In the aforementioned application examples, PAI resin was used as the binder. However, it is also possible to use polyamide resin or a mixture of polyamide resin and PAI resin.

Referring to FIG. 1 of the accompanying drawings, this plot demonstrates the (A) the relationship between the groove depth D on piston skirt portion (2) and the shear strength of resin coating layer (4), and (B) the relationship between the pitch P of lands (21) on the piston skirt portion (2), the groove depth d on resin coating layer (4) and the wear resistance of this layer. The shear strength and wear resistance of the resin coating layer (4) were measured in a continuous high-velocity durability test performed for 500 hours with a rotating velocity of 6,000 rpm.

The relationship between groove depth D on piston skirt(2) and shear strength of resin coating layer (4)

A lubricant-filled resin coating layer (4) prepared using the composition of Example 4 in Table I, (65 weight percent of PAI resin, 10 weight percent of PTFE, 20 weight percent of $MoS_2$, and 5 weight percent of graphite, was formed with a film thickness (t) of 12 μm, and with groove depth (d) of 8 μm on piston skirt portion (2). The pitch (P) of lands (21) on the piston skirt portion (2) was maintained constant at 0.2 mm, while the groove depth D was varied. The shear strength of resin coating layer (4) was determined and the results are plotted in FIG. 3.

For comparative purposes, the same study was conducted using a lubricant-filled resin coating layer (4) formed using the resin composition of Comparative Example 19 listed in Table II, which contained 47 weight percent PAI resin, 9 weight percent PTFE, 38 weight percent $MoS_2$, and 6 weight percent graphite. The results are also shown in FIG. 3.

Figure 3:
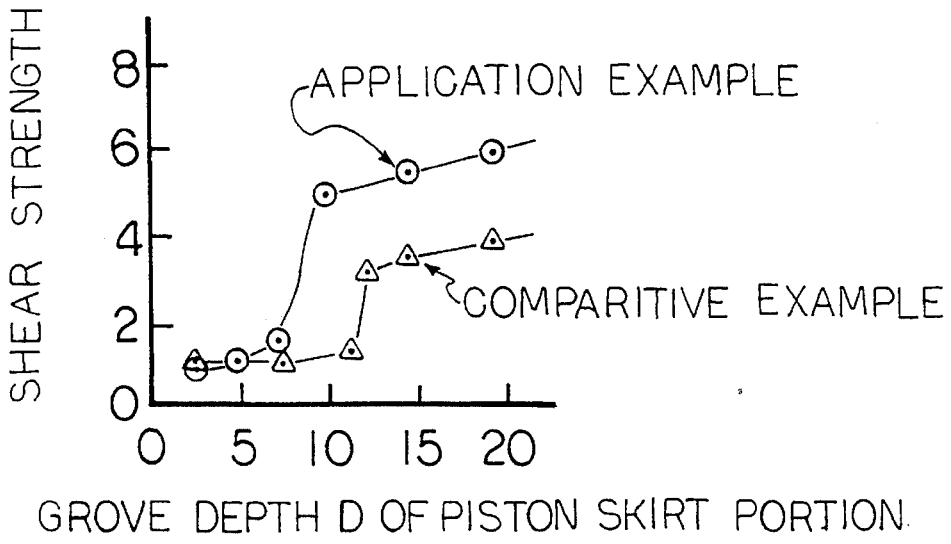
FIG. 3 is a plot illustrating the relationship between the depth D of the grooves in a pattern of lands and grooves on the piston skirt portion and the shear strength of the resin coating layer formed from the lubricant-filled resin composition of this invention.

It can be seen from FIG. 3 that for resin coating layer (4) exhibiting the composition of Example 4 of this specification, when the groove depth D on the piston skirt portion (2) is 10 μm or greater, the shear strength of resin coating layer (4), hence the bonding strength, can be increased drastically.

These results can be explained as follows: When lands (21) are present on piston skirt portion (2), the shear stress is concentrated at the these locations. Consequently, the shear strength of resin coating layer (4) decreases. However, as the depth D of the grooves is increased, the anchoring effect is enhanced, so that the decrease in the shear strength of resin coating layer (4) can be suppressed. However, when the groove depth D on the piston skirt portion (2) becomes deeper than 25 μm, the rigidity of the lands on the piston skirt portion (2) is significantly decreased, and deformation or breakage may occur. Consequently, the depth D of the grooves on piston skirt portion (2) should be in the range of 10–25 μm.

Comparison of these data with those for Comparative Example 19 indicates that the optimum value of groove depth D on the piston skirt portion (2) depends on the proportions of the resin binder and solid lubricants in resin coating layer (4). For the resin coating layer of Comparative Example 19 that exhibits a coefficient of friction and amount of wear larger than reported for Example 4, if the groove depth D on the piston skirt portion (2) is larger than 13 μm, there is no increase in the shear strength, and the relative increase in the shear strength is also smaller than the values reported for Example 4.

The relationship between pitch P on the piston skirt portion (2) and the amount of wear of resin coating layer (4)

A resin coating layer (4) with a thickness t of 15 μm and a groove depth d of 5–6 μm was formed on piston skirt portion (2) using the lubricant composition described Example 8 of the present invention, listed in Table I (50 wt. % of PAI resin, 15 wt. % of PTFE, 30 wt. % of $MoS_2$, and 5 wt. % of graphite. While the depth D of grooves (21) on piston skirt portion (2) was kept constant at 10 μm, the land pitch P was varied, and the amount of wear of resin coating layer (4) was measured after 500 hours of testing. The results are shown in FIG. 4.

Figure 4:
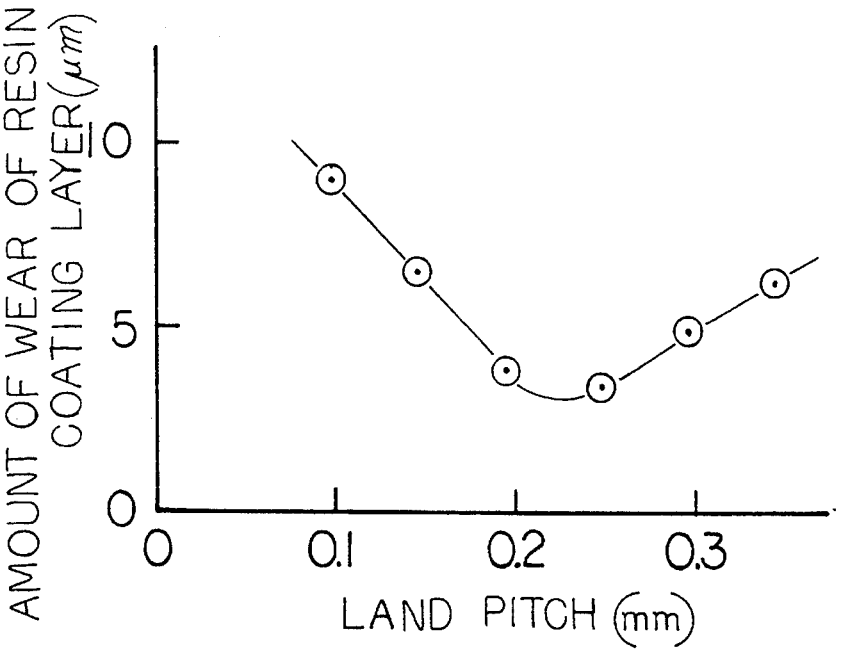
FIG. 4 is a plot illustrating the relationship between the land pitch P on the piston skirt portion and the amount of wear exhibited during testing of the present lubricant compositions.

The data in FIG. 4 demonstrate that for a resin coating layer (4) prepared in Application Example 8, by selecting the pitch P of lands (21) of piston skirt portion (2) in the range of 0.2–0.25 μm, it is possible to reduce the amount of wear of resin coating layer (4).

When the pitch P is larger than 0.25 mm, the amount of wear on the resin coating layer (4) is increased, and the retention of oil between the ridges is degraded. Also, it is believed that as the total area of the raised portion of the lands is reduced, the surface pressure on the lands rises, and the amount of wear increases. Resin coating layer (4) made of the resin composition prepared in Example 8 of the present invention contains PTFE. As PTFE has poor lipophilicity, the upper limit of pitch P is a function of the relative proportion of PTFE.

When pitch P is smaller than 0.2 μm, the amount of wear of resin coating layer (4) is increased. This increase occurs because when pitch P is too small, when resin coating layer (4) is coated, the surface tension of the coating material has significant influence, so that the surface of resin coating layer (4) is kept flat and the retention of oil is decreased. Because the oil cannot be retained on the sliding surface, the amount of wear is increased, and peeling of resin coating layer (4) may occur. Consequently, it is necessary to appropriately select the minimum value of pitch P of piston skirt portion (2) to ensure that depth d of grooves (41) of resin coating layer (4) is larger than the upper limit required to retain a prescribed amount of oil in the grooves (41) of the resin coating layer (4). This value that will be explained in a subsequent section of this specification. For resin coating layer (4) in this application example, this limit is 3 μm.

In order for groove depth d of resin coating layer (4) to be larger than the aforementioned limit of 3 μm, the pitch P on the piston skirt portion (2) should be 0.2 mm or larger.

The relationship between groove depth d of resin coating layer (4) and amount of wear on resin coating layer (4)

A resin coating layer (4) with a thickness t of 10 μm was formed on piston skirt portion (2) using composition that contained 65 wt. % of PAI resin, 5 wt. % of PTFE, 25 wt. % of $MoS_2$, and 5 wt. % of graphite. The depth D of grooves (21) of piston skirt portion (2) was maintained constant at 12 μm, the pitch P was maintained constant at 0.25 mm, and the groove depth d of resin coating layer (4) was varied. The amount of wear of resin coating layer (4) was measured after 500 hours of testing and the results are shown in FIG. 5.

Figure 5:
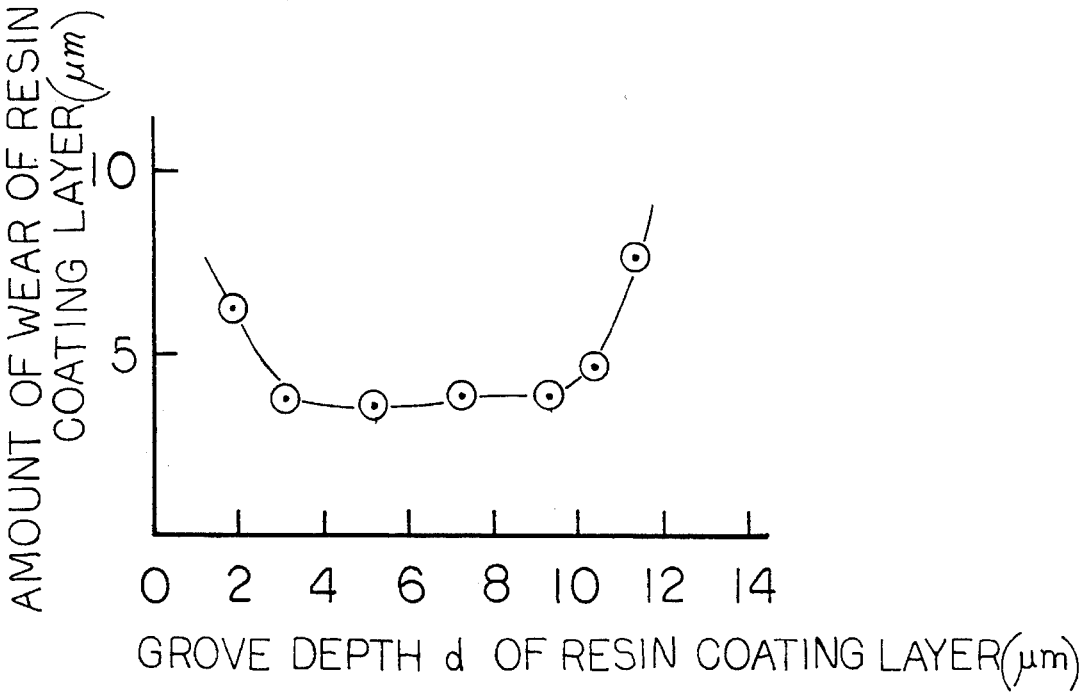
FIG. 5 is a plot illustrating the relationship between the groove depth d in a layer of lubricant-filled resin composition of this invention and the amount of wear exhibited by this layer.

It is evident from FIG. 5 that when the groove depth d of resin coating layer (4) is in the range of 3–10 μm, the amount of wear of resin coating layer (4) is reduced.

When the groove depth d of resin coating layer (4) is smaller than 3 μm, the amount of wear is increased. This is believed to be due to a decrease in the oil retention. When the groove depth d of resin coating layer (4) is larger than 10 μm, the amount of wear of resin coating layer (4) is increased. This is believed to be due to the excessive concentration of the stress at the land portions (41) of resin coating layer (4), causing serious wear.

The present inventors have also determined that in addition, the groove depth d of resin coating layer (4) depends on the film thickness t of resin coating layer (4) and pitches P and p.

As the depth d of the grooves in the resin coating layer (4) increases, the oil retention improves, with a resultant increase in the amount of the oil consumed. On the other hand, when depth d of the grooves in the resin coating layer (4) is decreased, oil retention is decreased, the amount of wear is increased, and seizing of the piston may occur under relatively low pressure. However, by adjusting the relative concentration of PTFE in the resin coating layer (4) so as to change the wetting property of the sliding surface, it is possible to realize a good sliding action.

The data in the accompanying figures indicate that to increase the bonding strength and wear resistance of resin coating layer (4) the groove depth D of the land/groove pattern (21) on piston skirt portion (2) is preferably in the range of 10–25 μm, the pitch P is preferably from 0.2–0.25 mm, and the groove depth d is preferably in the range of from 3–10 μm.

Examples 25–32

A resin coating layer (4) with a thickness t in the range of 10–20 μm was applied to piston skirt portion (2) using and air-propelled spray under conditions listed in Table V. The coating material contained 60 wt. % of PAI resin, 10 wt. % of PTFE, 25 wt. % of $MoS_2$, and 5 wt. % of graphite. The composition was prepared as described in Example 1, except that a 1.6:1 weight ratio mixture of n-methyl-2-pyrrolidone and diacetone alcohol was used as the solvent. In Table V, the groove depth D of piston skirt portion (2) and the groove depth d of the resin coating layer (4) are in units of μm, and the pitch P is in units of mm.

The PAI resin used was a commercially available polyamidimide varnish containing the same ingredients as Example 1 and 60 weight percent of PAI resin.

TABLE V

| Example No. | D | P | d | Piston Preheating Temperature | Viscosity | Air Pressure | Nozzle Aperture | Spray Rate (mL/min) |
|---|---|---|---|---|---|---|---|---|
| 25 | 20 | 0.2 | 6 | 90 | 120 | 5 | 1.5 | 30 |
| 26 | 15 | 0.25 | 8.5 | 95 | 135 | 5 | 1.2 | 20 |
| 27 | 8 | 0.2 | 5 | 90 | 110 | 4.5 | 1.2 | 25 |
| 28 | 30 | 0.25 | 18 | 80 | 120 | 5 | 1.2 | 28 |
| 29 | 13 | 0.2 | 2 | 120 | 100 | 5 | 1.5 | 34 |
| 30 | 13 | 0.25 | 12 | 80 | 110 | 4.5 | 1.5 | 30 |
| 31 | 15 | 0.1 | 1.5 | 120 | 95 | 4.5 | 1.2 | 32 |
| 32 | 15 | 0.3 | 8 | 90 | 120 | 5 | 1.5 | 30 |

The effect of varying a) the depth D and pitch P of the land/groove pattern (21) on piston skirt portion (2) and b) the groove depth d of resin layer (4) on the wear resistance of the coating layer was determined using the high-speed durability test described in a preceding section of this specification. The amount of wear of resin coating layer (4) was determined and the results are recorded in Table VI.

TABLE VI

| Example No. | Amount of Wear of Resin Coating Layer (μm) Following Time Interval t | | | | | | | | |
|---|---|---|---|---|---|---|---|---|---|
| | 25 Hrs. | 50 Hrs. | 75 Hrs. | 100 Hrs. | 150 Hrs. | 200 Hrs. | 300 Hrs. | 400 Hrs. | 500 Hrs. |
| 25 | 2.8 | 3.5 | 3.9 | 4.2 | 4.8 | 4.9 | 5.1 | 5.1 | 5.2 |
| 26 | 2.9 | 3.8 | 3.9 | 4.6 | 5.1 | 5.3 | 5.4 | 5.5 | 5.5 |
| 27 | 2.4 | 3.5 | 4.0 | — | — | — | — | — | — |
| 28 | 3.5 | 4.8 | 6.1 | 7.8 | 9.5 | 12.0 | 15.8 | 16.9 | 17.5 |
| 29 | 2.0 | — | — | — | — | — | — | — | — |
| 30 | 2.9 | 4.4 | 5.6 | 6.9 | 7.9 | 9.2 | — | — | — |
| 31 | — | — | — | — | — | — | — | — | — |
| 32 | 2.9 | 3.7 | 4.2 | — | — | — | — | — | — |

A comparison of the results for sample Nos. 25 and 26 compared with the results for sample Nos. 27–32 demonstrates that the bonding strength and wear resistance of resin coating layer (4) are increased by using the following dimension ranges: the groove depth D of on piston skirt portion (2) from 10–25 μm; the pitch P on piston skirt portion (2) from 0.2–0.25 mm, the groove depth d in resin layer (4) from 3–10 μm, and by selecting the relative concentrations of ingredients of resin coating layer (4) from within the ranges of this invention. In this way, the coefficient of friction of resin coating layer (4) can be reduced, and the initial conformability can be improved. By observing these limitations it is possible to reduce the steady-state amount of wear of resin coating layer (4), and maintain a well lubricated state on the moving surface, as determined by oil retention and surface pressure.

On the other hand, for sample No. 27, with a groove depth D on the piston skirt portion (2) of less than 10 μm, the shear strength of resin coating layer (4) is insufficient, and resin coating layer (4) peeled off after 100 hours of testing.

For sample No. 28 with a groove depth D on the piston skirt portion (2) greater than 25 μm and a groove depth d on the resin coating layer (4) greater than 10 μm, and for sample No. 30 with a groove depth d on the resin coating layer (4) greater than 10 μm, the amount of wear at the top of the land portions of the resin coating layer (4) was excessive, and the steady-state amount of wear increased.

For sample No. 29 with a groove depth d smaller than 3 μm, for sample No. 31 with a groove pitch P smaller than 0.2 μm, and for sample No. 32 with a pitch P larger than 0.25 μm, as the oil retention was decreased, peeling of resin coating layer (4) occurred.

Examples 33 and 34

Following the procedure described for Examples 1–24 a lubricant-filled resin composition coating containing the relative concentrations of ingredients listed in Table VII was prepared and applied to a substrate of aluminum alloy AC8A. For sample Nos. 33 and 34, the concentrations of PAI resin, PTFE, $MoS_2$ and graphite were within the ranges of the present invention.

The composition described in example 11 of the present specification was used for comparative purposes. In this composition the relative concentrations of PTFE, $MoS_2$ and graphite with respect to one another were within the range of the present invention, but these ingredients comprised only 25 wt % of the lubricant composition, which is outside the range of the present invention. The results of the evaluations are recorded in Table VII.

TABLE VII

| Example No. | Composition of Solid Lubricant (Parts by Weight) PTFE | $MoS_2$ | Graphite | Concenration of Solid Lubricant (Weight %) | Concenration of Resin Binder (Weight %) |
|---|---|---|---|---|---|
| Present Invention | | | | | |
| 33 | 5 | 20 | 2 | 27 | 73 |
| 34 | 3 | 20 | 4 | 27 | 73 |
| Comparative Example 11 | 3 | 20 | 2 | 25 | 75 |

Evaluation of coefficient of friction, amount of wear, and seizure resistance

The test procedures for measuring these properties are described in a preceding section of this specification. The results for examples 33, 34 and comparative example 11 are reported in Table VIII.

TABLE VIII

| Example No. | Coefficient of Friction Following Time t: t = 0 Hrs. | t = 100 Hrs. | Amount of Wear (μm) | Surface Pressure in Case of Seizure (Mpa) |
|---|---|---|---|---|
| Present Invention | | | | |
| 33 | 0.032 | 0.028 | 5.8 | 28 |
| 34 | 0.033 | 0.028 | 5.9 | 30 |
| Comparative Example 11 | 0.033 | 0.041 | 7.3 | 21 |

The data in Table VIII demonstrate that in Comparative Example 11 containing too low a total concentration of solid lubricant, although the coefficient of friction immediately after start of the test was at a relatively low level of 0.33, it rises significantly over time. This is because the surface area of the solid lubricants with respect to the sliding surface is small. Consequently, wear is promoted, and the roughness of the surface is increased.

By comparison, in Application Example 33, when the relative concentration of PTFE, which has the most significant influence on the value of the coefficient of friction, is increased, the initial coefficient of friction immediately after start of the test is low, and the coefficient of friction after 100 hours of testing is also low.

Figure 6:
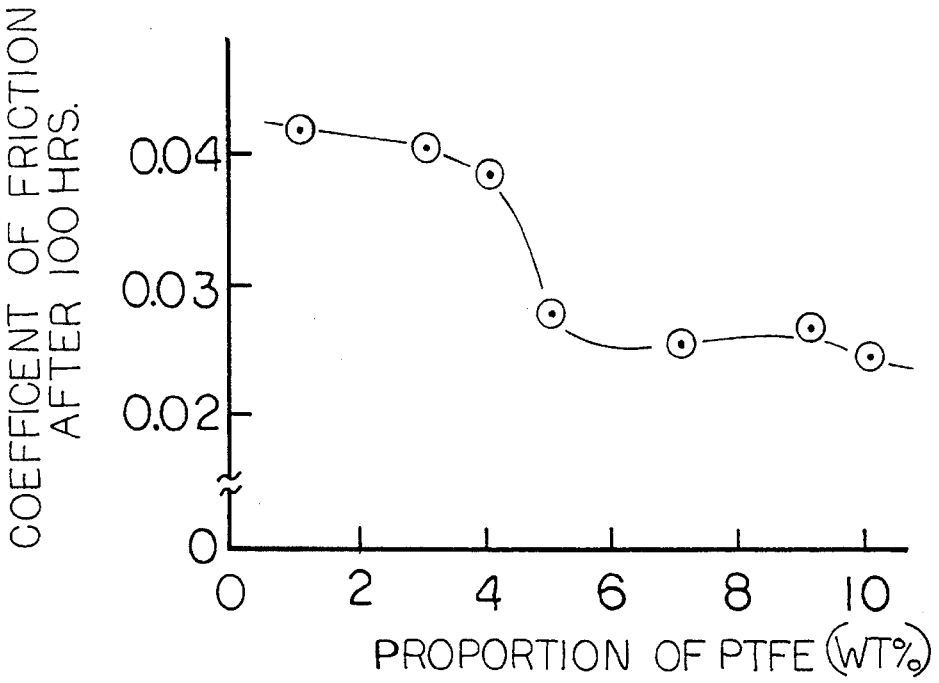
FIG. 6 is a plot illustrating the relationship between the relative concentration of PTFE and the coefficient of friction measured after 100 hours of testing. The relative concentration of $MoS_2$ is kept constant at 20 wt. % and the proportion of graphite is kept constant at 2 wt. %.

The relative concentration of $MoS_2$ was maintained constant at 20 wt. % and the relative concentration of graphite was maintained constant at 2 wt. %, while the proportion of PTFE was varied within the range of 1–10 wt. %. The coefficient of friction was measured after 100 hours of testing and the results are plotted in FIG. 6.

The data indicate that when the composition contains 20 weight percent of $MoS_2$ and 2 weight percent of graphite, as the proportion of PTFE was increased to above 5 wt. %, the coefficient of friction measured after 100 hours of testing was significantly reduced.

Compared with Comparative Example 11, in Example 34, the amount of graphite, which has a high influence on the seizure resistance, is large, with the result that the coefficient of friction decreased during the test.

To determine the effect of varying the graphite concentration on the coefficient of friction, the relative concentration of $MoS_2$ was maintained constant at 20 wt. %, the relative concentration of PTFE was maintained constant at 3 wt. and the relative concentration of graphite was varied from 1 to 8 wt. %. The coefficient of friction of the samples was measured after 100 hours of testing, and the results are shown in FIG. 7.

Figure 7:
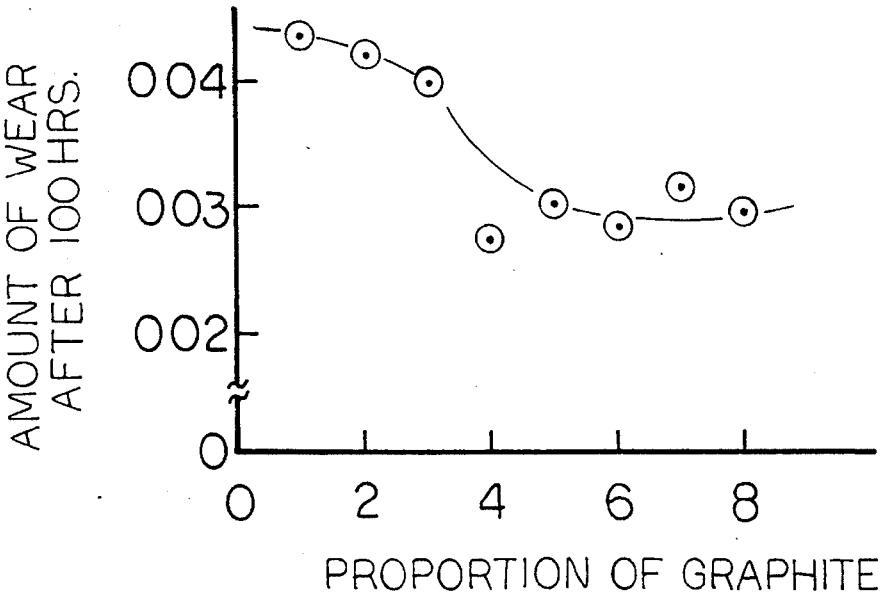
FIG. 7 is a plot illustrating the relationship between the relative concentration of graphite and the coefficient of friction measured after 100 hours of testing. The relative concentration of $MoS_2$ is kept constant at 20 wt. % and the relative concentration of PTFE is kept constant at 3 wt. %.

The data in FIG. 7 demonstrate that for a composition containing 20 wt. % of $MoS_2$ and 3 wt. % of PTFE, when the relative concentration of graphite was greater than 4 wt. %, the coefficient of friction 100 hours after start of the test could be significantly reduced. This is because as both graphite and $MoS_2$ are used, the seizure resistance (pressure required for seizing) is increased, and the smooth surface formed by sliding can be maintained. At these levels of $MoS_2$, and PTFE, when the relative concentration of graphite is larger than 3 wt. %, no improvement in the seizure resistance is observed, and intralayer peeling takes place in the resin coating layer due to the load. Consequently, the increase in wear presents a serious problem.

The present lubricant-filled resin compositions for sliding parts exhibit a lower coefficient of friction, a smaller steady-state amount of wear, and a higher seizure resistant surface pressure. Consequently, when the compositions are applied to the skirt portion of an engine piston, an increase in the seizure resistance within the cylinder bore can be expected.

As the coefficient of friction decreases, the mileage of the engine is expected to be increased about 1 to 2%. As the wear resistance increases, wear of the resin coating layer can be suppressed, and attachment to the surface of the cylinder bore can be alleviated. Formation of a mirror surface on the cylinder bore can be prevented.

That which is claimed is:

1. A wear resistant lubricant composition comprising from 50 to 73 weight percent of a binder consisting essentially of at least one member selected from the group consisting of polyamidimide resins and polyamide resins, and, as solid lubricants, from 3 to 15 weight percent of polytetrafluoroethylene, from 20 to 30 weight percent of molybdenum disulfide, and from 2 to 8 weight percent of graphite; wherein the total concentration of said solid lubricants constitutes from 27 to 50 percent of the total weight of said composition.

* * * * *